US005407333A

United States Patent [19]

Lambright

[11] Patent Number: 5,407,333

[45] Date of Patent: Apr. 18, 1995

[54] SUBSURFACE PUMP WITH PUMP ROD CONNECTED VALVE BALL

[76] Inventor: Charles T. Lambright, 15902 Seven Springs, Houston, Tex. 77084

[21] Appl. No.: 134,663

[22] Filed: Oct. 12, 1993

[51] Int. Cl.[6] ..... F04B 47/00; F04B 7/00

[52] U.S. Cl. ..... 417/514; 417/520; 417/552; 417/554

[58] Field of Search ..... 417/545, 552, 554, 555.2, 417/511, 514, 520

[56] References Cited

U.S. PATENT DOCUMENTS

| | | | |
|---|---|---|---|
| 61,209 | 1/1867 | Kelly | 417/511 |
| 1,614,000 | 1/1927 | Hendricks | 417/511 |
| 2,090,209 | 8/1937 | Larson et al. | 417/511 |
| 2,214,965 | 9/1940 | Dunlap | 417/552 |
| 2,408,109 | 9/1946 | Thompson | 417/511 |
| 4,591,316 | 5/1986 | Vadasz Fekete | 417/514 |
| 5,009,000 | 4/1991 | Wilmeth et al. | 417/554 |

FOREIGN PATENT DOCUMENTS

| | | | |
|---|---|---|---|
| 37721 | 6/1909 | Austria | 417/552 |

*Primary Examiner*—Richard A. Bertsch

*Assistant Examiner*—Roland G. McAndrews, Jr.

*Attorney, Agent, or Firm*—Kenneth A. Keeling

[57] ABSTRACT

A rod-driven, downhole pump is disclosed, the pump including a traveling barrel contained within a pump housing, a central pump rod extending axially within the barrel, a valve ball located at the lower end of the pump rod, a valve seat near the barrel lower end, the pump rod including a rod shoulder for engaging the upper end of the barrel, the barrel containing annular passageways for the flow of fluid through the barrel, the pump rod reciprocable within the barrel, and the barrel reciprocable within the pump housing. The downward stroke of the pump rod causes the rod shoulder to engage the barrel upper end and concurrently displaces the valve ball below the valve seat, thereby allowing environmental fluid to flow through the barrel annular passageways. On the up stroke of the pump rod, the valve ball engages the valve seat and pushes the pump barrel upward within the pump housing. The sealing of the valve ball on the valve seat and the upward movement of the barrel displace columnar fluid upwardly.

8 Claims, 3 Drawing Sheets

SUBSURFACE PUMP WITH PUMP ROD CONNECTED VALVE BALL

BACKGROUND OF THE INVENTION

1. Field of the Invention

The subsurface pump of the present invention relates generally to the field of downhole pumps used in wells to pump liquids such as water and oil, and more particularly to rod-driven pumps for recovering oil from subsurface formations.

2. Description of the Prior Art

Subsurface pumps are used in water wells and in oil wells in a variety of environments to pump fluids of widely varying flow characteristics.

Conventional rod-driven subsurface pumps include a cylindrical housing disposed in the well casing in the subterranean area of oil production. Typically a rod string, the sucker rod, extends into the pump housing and is connected to a plunger contained within the housing. The sucker rod is reciprocated thereby causing the plunger to move upwardly and downwardly. A stationary or standing valve is typically located at the bottom of the pump controlling flow of liquid into the pump housing. Liquid flows into the pump housing on the up stroke. The stationary valve limits flow into the housing during the down stroke.

An upper, traveling valve reciprocates with the sucker rod. The traveling valve opens during the down stroke due to the pressure of fluid trapped between the plunger and the stationary valve. Opening of the traveling valve allows fluid to flow into the pump housing above the valve, which fluid is forced upward on the up stroke of the rod and plunger. Significant pressures are generated due to the compression of fluid between the plunger and the stationary valve.

Conventional subsurface pumps typically include a ball and seat arrangement for the standing valve and for the traveling valve. The seat is typically provided below the ball, with the ball contained within a cage, the cage limiting upward movement of the ball.

In conventional arrangements, the plunger is on the up stroke before the traveling valve is engaged. A quantity of fluid escapes through the seat prior to engagement of the ball. The downward flow of fluid forces the ball to the bottom of the cage and onto the seat. This closing mechanism creates high velocity fluid flow at the interface of the ball and seat, the fluid often containing particulate matter, such as sand. Erosion of the ball and seat and reduced pumping capacity result.

Conventional pumping units, utilizing a traveling valve and a standing valve, are subject to high impact pressures on the valves due to fluid between the traveling valve and the seating valve or due to columnar fluid and the reciprocation of the plunger. The impact pressures, gas pounding or liquid pounding, result in wear and failure of the pump.

The following United States patents are indicative of the prior art.

Adams, et al., U. S. Pat. No. 1,549,175 discloses a rod-driven, double acting hollow plunger pump including a standing tube and a double-walled plunger, the standing tube contained between the walls of the standing tube.

Adams U. S. Pat. No. 2,160,811 discloses a rod-driven, traveling barrel pump including two spaced pairs of sealing surfaces on the barrel and plunger defining an annular space that is vented to the interior of the plunger.

Grise U.S. Pat. No. 2,413,044 discloses means for priming a grease pump including a pump cylinder, a priming cylinder and associated ball and seat valves.

Wells U. S. Pat. No. 3,212,444 discloses a multizone rod-driven pump for use in slim-hole wells including upper and lower plungers, the upper plunger and rod having a passageway in communication with the lower section of the upper pump barrel.

Simon U.S. Pat. No. 4,219,311 discloses a rod-driven pump having a fluid communication passage bypassing a valve to limit gas or liquid pounding.

Fekete U. S. Pat. No. 4,740,141 discloses a pump having a piston plunger with a valve, a valve ring, and a valve plug disposed in the plunger.

Simon, deceased et al. U.S. Pat. No. 4,596,515 discloses a rod-driven pump having a valve operable near the end of the downward rod stroke for the passage of fluid into the pump chamber to limit gas or liquid pounding.

SUMMARY OF THE PRESENT INVENTION

It is an object of the present invention to provide a subsurface, rod-driven pump operable in a downhole environment to provide effective pumping absent limitations of pumps disclosed in the prior art, such limitations including excessive wear due to infiltration of sand and particulate matter, failure due to gas and liquid pounding, and limited pumping capacity.

It is an object of the present invention to provide a rod-driven, subsurface pump utilizing fluid column pressure and environmental fluid pressure to facilitate opening and closing of the pump seal.

It is a further object of the present invention to provide a rod-driven, subsurface pump having a pump seal, said seal seating while immersed in environmental fluid.

It is a further object of the present invention to provide a rod-driven, subsurface pump having a pump seal, the sealing pressure on the pump seal equivalent to the fluid pressure of the fluid contained in the well string column.

It is a further object of the present invention to provide a rod-driven, subsurface pump having a pump seal wherein the columnar fluid opposes seal disengagement due to downhole gas pressure.

It is a further object of the present invention to provide a rod-driven, subsurface pump having a pump seal, said seal seating at the beginning of the up stroke, thereby more effectively pumping environmental fluid.

It is a further object of the present invention to provide a rod-driven, subsurface pump having a pump seal, the pump seal relatively resistant to erosion.

It is a further object of the present invention to provide a rod-driven, subsurface pump of simple construction and resistant to wear.

Other objects of the invention will become apparent from time to time throughout the specification and claims as hereinafter related.

The foregoing and other objects of the present invention are accomplished by a rod-driven, downhole pump including a traveling barrel contained within a pump housing, a central pump rod extending axially within the barrel, a valve ball located at the lower end of the pump rod, a valve seat near the barrel lower end, the pump rod including a rod shoulder for engaging the upper end of the barrel, the barrel containing annular passageways for the flow of fluid through the barrel, the pump rod reciprocable within the barrel, and the barrel reciprocable within the pump housing. The distance between the rod shoulder and the valve ball is greater than the distance between the valve seat and the barrel upper end. The downward stroke of the pump rod causes the rod shoulder to engage the barrel upper end and concurrently displaces the valve ball below the valve seat, thereby allowing environmental fluid to flow through the barrel annular passageways. On the up stroke of the pump rod, the valve ball engages the valve seat and pushes the pump barrel upward within the pump housing. The sealing of the valve ball on the valve seat and the upward movement of the barrel displace fluid upwardly within the pump housing and the well string. A conventional ball and seat standing valve is provided below the pump rod and barrel to allow flow into the pump housing on the up stroke and to prevent downward flow of fluid from the pump housing.

BRIEF DESCRIPTION OF THE DRAWINGS

FIG. 6 depicts a partial cross-sectional view of the pump of the present invention and a standing valve.

DESCRIPTION OF THE PREFERRED EMBODIMENT

Figure 1:
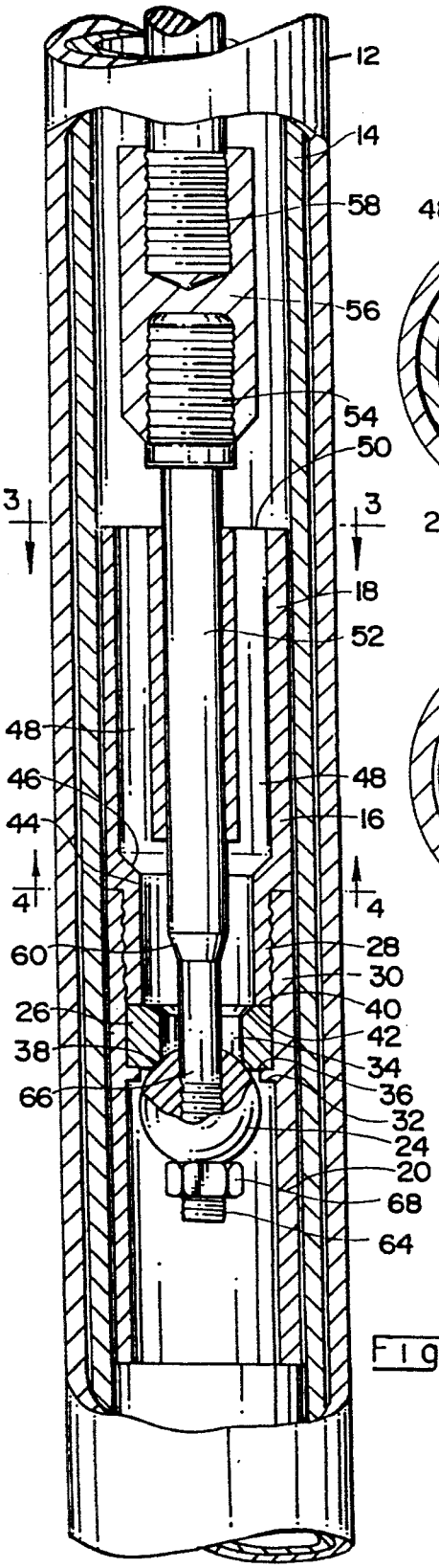
FIG. 1 illustrates a partial cross-sectional view of the pump of the present invention in the up-stroke condition with the valve ball engaging the valve seat.

Referring first to FIG. 1, the subsurface pump 10 of the present invention is depicted in partial cross-section. The pump 10 is disposed within a well string 12, well string 12 being a conventional tubular member utilized in the drilling of oil and gas wells. A pump housing 14, comprising a tubular member is contained within well string 12 and axially aligned with the well string 12. An elongated, cylindrical pump barrel 16, comprising an upper barrel 18 and a lower barrel 20 is contained within pump housing 14 and axially aligned therewith. An elongated pump rod 22 is contained within barrel 16 and axially aligned therewith. A valve ball 24 is connected to the lower end of pump rod 22, the valve ball 24 engaging, in FIG. 1, a valve seat 26 connected to the barrel 16.

Still referring to FIG. 1, the tubular pump housing 14 external diameter is sized to fit loosely within the interior diameter of well string 12. Tubular pump housing 14, in the preferred embodiment, is an elongated tubular member of a length of approximately 10 feet (3 meters). Pump housing 14 is slidably contained within the well string 12.

Pump barrel 16 includes an upper barrel 18 connected to a lower barrel 20. A threaded nipple 28 is provided at the lower end of upper barrel 18 for connection to corresponding interior threading provided in upper extension 30 of lower barrel 20. An inwardly-extending rim 32 is provided on lower barrel 20, said rim 32 located below the threading provided on extension 30 and spaced therefrom. Valve seat 26 comprising a hollow, cylindrical member is disposed between the threading provided on upper extension 30 and rim 32, valve seat 26 resting on and supported by rim 32. Upon engagement of the threading of nipple 28 with extension 30, the valve seat 26 is fixedly contained between the lower end of nipple 28 and rim 32.

Valve seat 26 is provided with a central, axial aperture 34. The lower surface 36 of valve seat 28 is inclined upwardly at its inner lip 38. The upper surface 40 of valve seat 28 is additionally provided with a downwardly-inclined lip 42.

Still referring to FIG. 1, upper nipple 28 is provided with a hollow core 44, said hollow core 44 extending into upper barrel 18 and expanding at inclined shoulder 46 provided internally of upper barrel 18. Upper barrel 18 is provided with a hollow center 52 extending from upper end 50. The hollow core 44 provides fluid communication with annular passageways 48 provided in upper barrel 18. The annular passageways 48 extend from the upper end 50 of upper barrel 18 to hollow core 44 and are axially aligned exterior of hollow center 52 of upper barrel 18.

Pump rod 22 extends through hollow center 52 and hollow core 44. Pump rod 22 is threadably connected at its upper end 54 to threaded connector 56. Threaded connector 56 is threadably connected to the sucker rod 58. Sucker rod 58 extends to a surface pumping unit (not shown), the pumping unit reciprocating sucker rod 58 and pump rod 22 during operation.

Pump rod 22 is sized such that pump rod 22 slidably fits within hollow center 52 of upper barrel 18. Pump rod 22 defines an annular cavity in hollow core 44. An inclined shoulder 60 is provided on pump rod 22 below hollow center 52 at hollow core 44.

A flange 62 is provided at upper end 54 of pump rod 22, said flange 62 adjacent connector 56 and spaced from upper end 50 of upper barrel 18.

A valve ball 24 is connected to the lower end 64 of pump rod 22. The valve ball 24 is provided with a threaded, hollow core 66 for threaded engagement to lower end 64. A nut 68 secures ball 24 onto pump rod 22.

Figure 5:
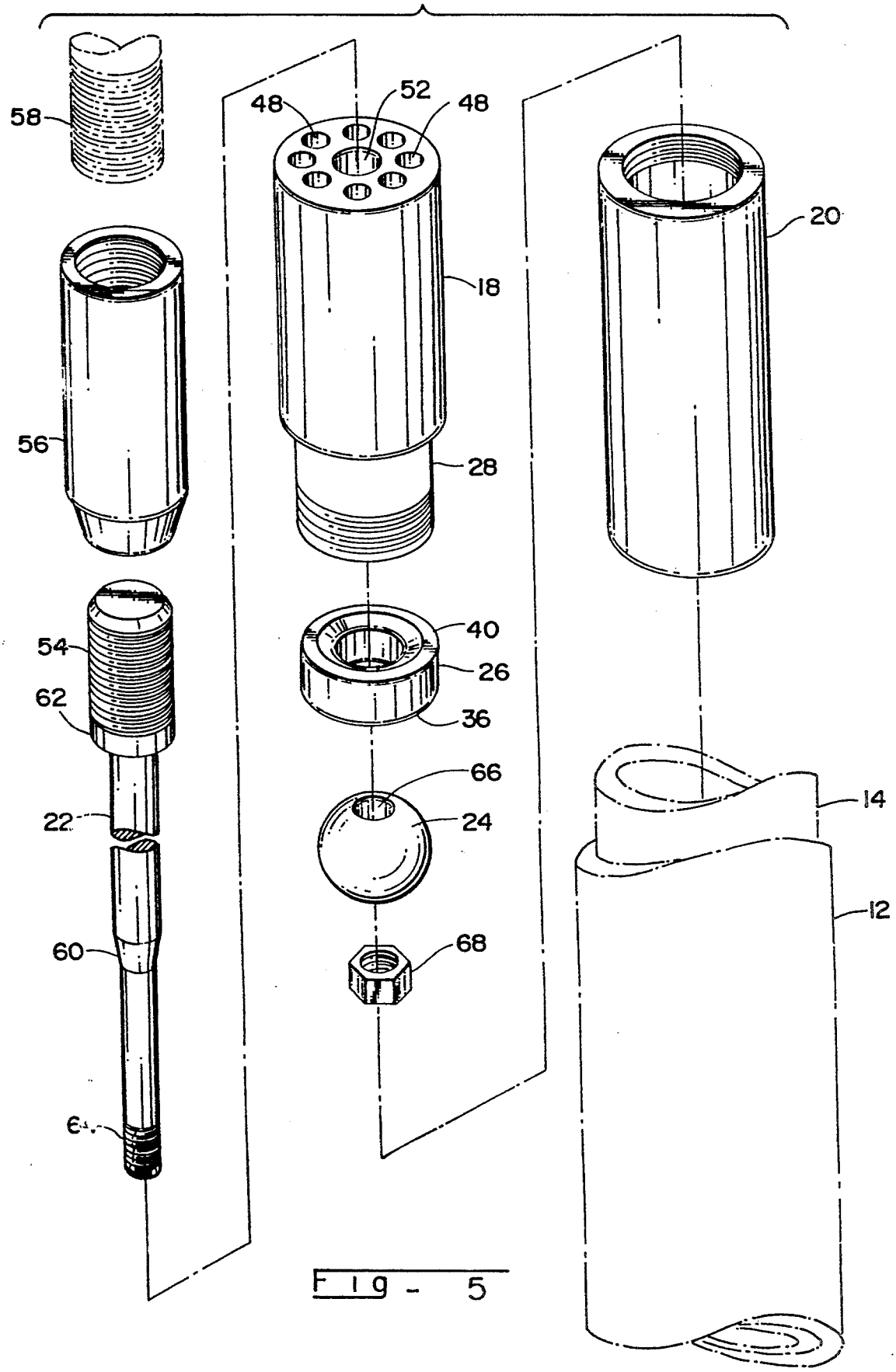
FIG. 5 depicts an isometric view of various components of the rod, barrel and valve of the present invention.
Figure 5:
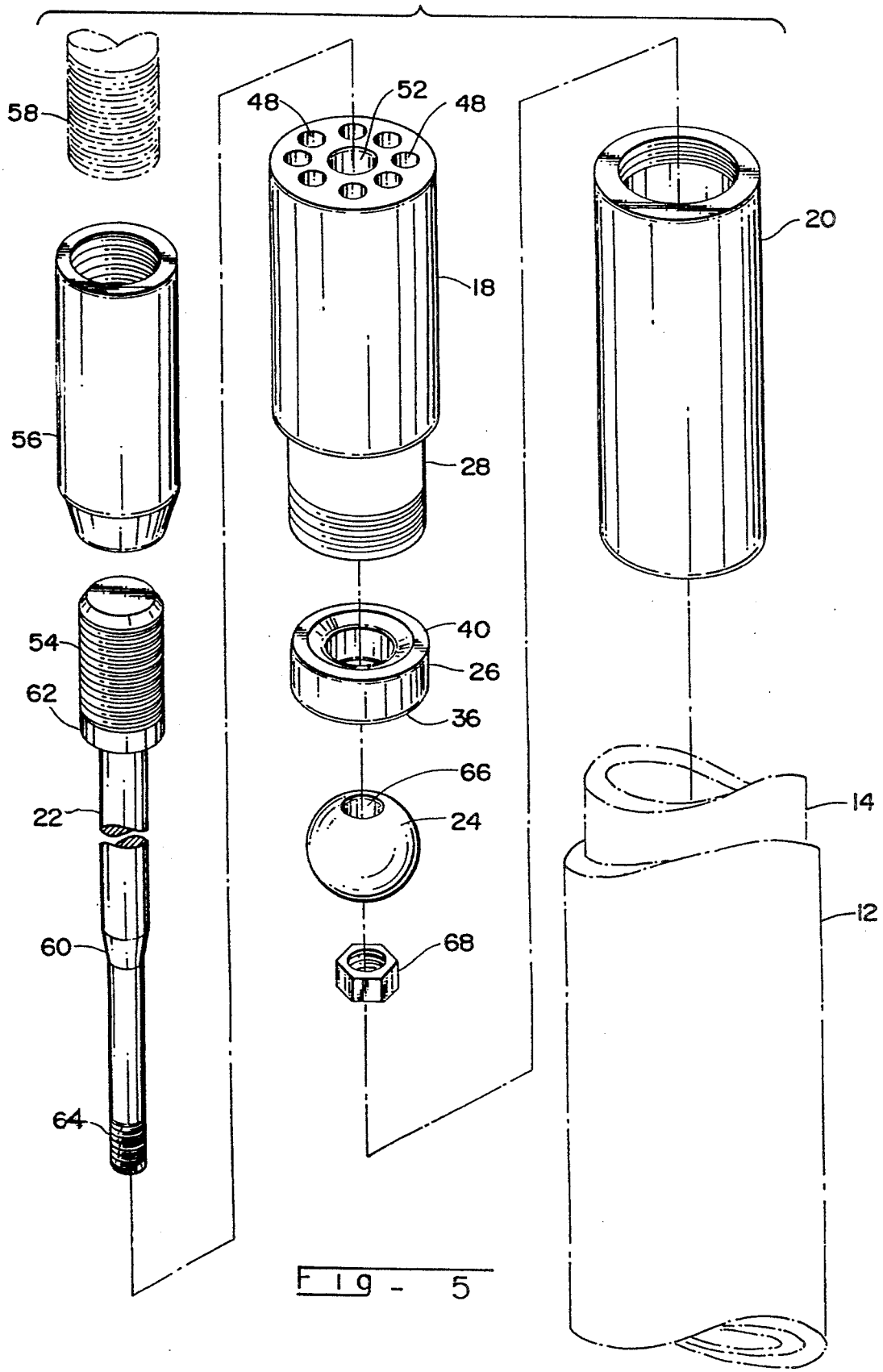

Referring next to FIG. 5, an isometric view of the components of the subsurface pump 10 of the present invention is depicted. The sucker rod 58 threadably engages connector 56, which connector 56 threadably engages upper end 54 of pump rod 22. Flange 62 is adjacent threaded upper end 54. Inclined shoulder 60 of pump rod 22 is provided intermediate of flange 62 and threaded lower end 64. Pump rod 22 extends through upper barrel 18, the relatively wider section of pump rod 22 above inclined shoulder 60 slidably engaging hollow center 52 of upper barrel 18.

Eight annular passageways 48 are provided in upper barrel 18, the passageways 48 axially aligned with center 52.

Threaded nipple 28 extends downwardly from upper barrel 18, the threaded nipple 28 having a smaller external diameter than upper barrel 18. Hollow, cylindrical valve seat 26 abuts the lower end of nipple 28 at valve seat 26 upper surface 40. The lower surface 36 of valve seat 26 abuts the upper end of lower barrel 20.

The lower barrel 20 is provided with interior threading for threaded connection to the threaded nipple 28. The external diameter of valve seat 26 is so sized as to fit within the cylindrical wall of lower barrel 20. Valve ball 24 is threadably connected to the lower end 64 of pump rod 22 and is retained on lower end 64 by nut 68.

Upper barrel 18 and lower barrel 20 have substantially equivalent external diameters. The pump barrel 16, comprising upper barrel 18 and lower barrel 20, slidably fits within the cylindrical wall of pump housing 14. The pump housing 14 slidably fits within the cylindrical wall of well string 12.

Figure 3:
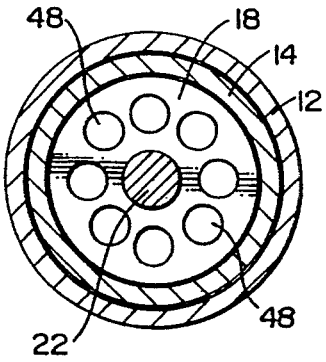
FIG. 3 depicts a cross-sectional view along lines 3—3 of FIG. 1.

Referring to FIG. 3 a partial cross-sectional plan view of the subsurface pump 10 is depicted along lines 3—3 of FIG. 1. FIG. 3 depicts the concentric arrangement of pump rod 22 within upper barrel 18, the upper barrel 18 within pump housing 14, and pump housing 14 within well string 12. Eight annular passageways 48 are radially spaced in the body of upper barrel 18.

Figure 4:
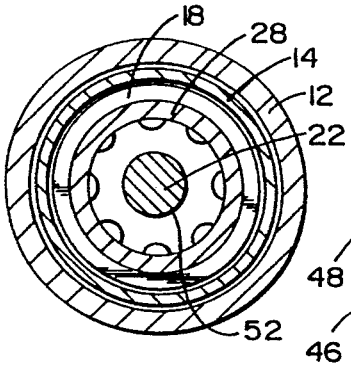
FIG. 4 depicts a cross-sectional view along lines 4—4 of FIG. 1.

Referring to FIG. 4, a partial cross-sectional view of the subsurface pump 10 is depicted along lines 4—4 of FIG. 1. Pump rod 22 is depicted within hollow center 52 of upper barrel 18. Nipple 28 extends from upper barrel 18.

Figure 2:
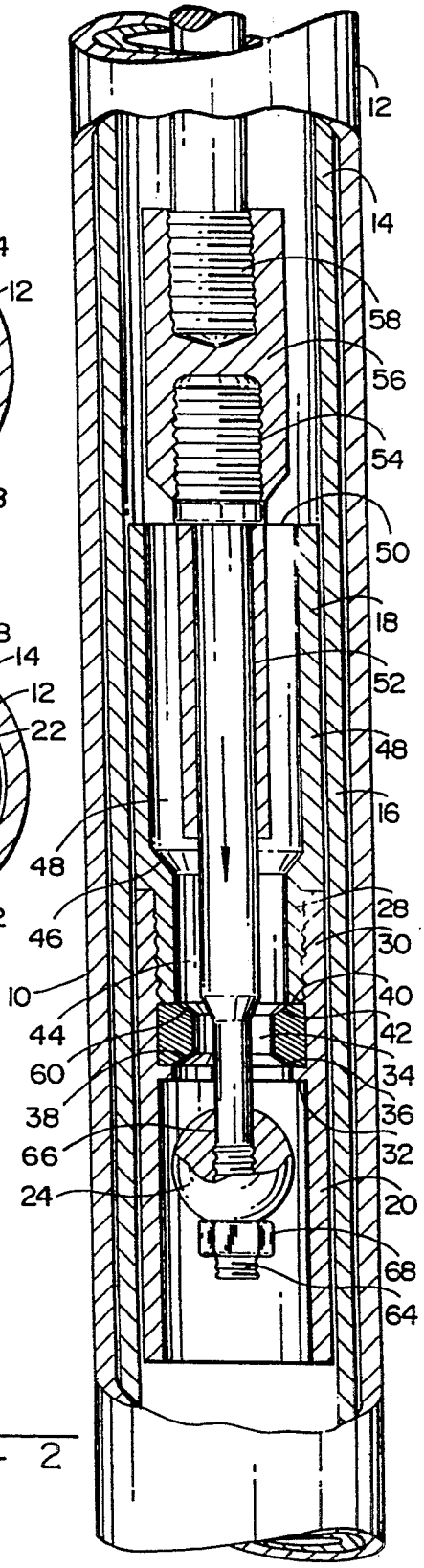
FIG. 2 illustrates a partial cross-sectional view of the pump of the present invention in the down-stroke condition with the rod shoulder engaging the upper end of the pump barrel.

Referring now to FIG. 2, the subsurface pump 10 is depicted in partial cross-section as in FIG. 1, FIG. 2 depicting the relative position of pump rod 22 and pump barrel 16 with the sucker rod 58 on the down stroke.

Referring to FIG. 6, the pump 10 of the present invention is shown in relation to a conventional standing valve 66. Standing valve 66 includes a valve ball 68 in a cage 70. An orifice 72 is provided in the bottom 74 of cage 70, orifice 72 and ball 68 so sized that ball 68 is engageable with orifice 72 in a sealing arrangement. Two orifices 76 are provided in the top 78 of cage 70. Standing valve 66 is structured to limit downward flow of fluid, the ball 68 and the orifice 72 sealingly engaged by downward flow of fluid, and to allow the upward flow of fluid through at least one of the orifices provided in the top 78 of cage 70.

The standing valve 66 is connected to the pump housing 14 and is stationary in relation to the pump housing 14. The pump 10 is sufficiently removed from standing valve 66 to prevent the pump 10 from contacting the standing valve 66.

Operation

Referring to FIG. 1, the relative arrangement of the pump rod 22 and the barrel 16 on the up stroke of the sucker rod 58 is depicted. On the up stroke of rod 58, pump rod 22 is drawn upward. At the beginning of the up stroke, the valve ball 24 engages the inclined lip 38 of valve seat 26 thereby sealing environmental fluid (not shown) above valve seat 26 within the pump housing 14. As the up stroke continues, the barrel 16 is drawn upward, the barrel 16 pushing columnar fluid contained above the barrel 16 within the pump housing 14 upward. The rod 58 is displaced a relatively small distance before the valve ball 24 engages valve seat 26. The relative placement of the valve ball 24 and the valve seat 26 and the absence of compressive forces limit erosive forces on the valve ball 24 and valve seat 26.

During the up stroke, a reduced, suction pressure is induced below the barrel 16 within the pump housing 14. When the pressure below barrel 16 becomes less than the pressured of environmental fluid, the ball 68 of standing valve 66 becomes disengaged from orifice 72 and environmental fluid flows into pump housing 14 through standing valve 66.

Referring to FIG. 2, the relative arrangement of the pump rod 22 and the barrel 16 on the down stroke is depicted. At the beginning of the down stroke of rod 58, the pump rod 22 is pushed downwardly. Barrel 16 initially travels with pump rod 22. Upon sufficient downward movement of the barrel 16 during the down stroke barrel 16 contacts environmental fluid retained in the pump housing 14 by standing valve 66 or encounters pressure from fluid retained in the pump housing 14 by standing valve 66. Upon such contact or pressure resistive to downward movement of the barrel 16, the pump rod 22 travels through barrel 16 until the underside of flange 62 engages the upper end 50 of upper barrel 18. The ball valve 24 is concurrently disengaged from valve seat 26. As the down stroke continues, flange 62 pushes barrel 16 downwardly within pump housing 14. After the ball valve 24 is disengaged from the valve seat 26, fluid communication is maintained from the interior of the pump housing 14 below the valve seat 26 through the hollow core 44 and the passageways 48 to the section of the pump housing 14 above the barrel 16, thereby allowing environmental fluid (not shown) to flow through the barrel 16, which fluid is then pushed upwardly on the next up stroke.

The construction of the pump 10 allows ready replacement of the valve seat 26, valve seat 26 being replaceable by unscrewing the upper barrel 18 from the lower barrel 20, inserting a replacement valve seat 26 and reconnecting the upper barrel 18 to the lower barrel 20. The valve ball 24 is readily replaceable by removing nut 68 and the valve ball 24 and replacing the valve ball 24 and nut 68.

In operation the pump 10 utilizes the pressure of the fluid (not shown) contained in the well string above the pump 10, the column fluid, to maintain sealing engagement between the valve ball 24 and the valve seat 26. As the valve ball 24 induces the valve seat 26 upward, and the valve ball 24 and valve seat 26 retain all column fluid above the valve ball 24 and valve seat 26, the weight of the column fluid biases the valve seat 26 against valve ball 24. Such pressure is sufficient to overcome a common problem incurred in downhole pumps, referred to as gas lock, wherein the pressure of environmental gas causes the valve ball to disengage from the valve seat.

The sealing of valve ball 24 against the valve seat 26 occurs at the initiation of the up stroke, at a time when the valve ball has travelled a relatively short distance, approximately one to two inches (2.5 to 5.1 cm). Sealing engagement therefore occurs at a time when there is relatively low differential pressure between the areas above and below the sealing interface. There is therefore relatively low velocity of fluid flow between the valve ball 24 and the valve seat 26.

The short distance travelled by the valve ball 24 prior to engagement with the valve seat 26 on the up stroke limits the amount of fluid escaping between the valve ball 24 and the valve seat 26, thereby enhancing pump efficiency.

Although the subsurface pump 10 of the present invention has been described in terms of a preferred embodiment, it will be apparent that variations of the invention may be practiced within the scope of the disclosure and the appended claims.

I claim:

1. A pump operable in a tubular well string, said well string containing environmental fluid therein, the pump comprising:

a pump housing;

a pump barrel slidably disposed in said pump housing;

a first pump housing interior above said pump barrel;

a second pump housing interior below said pump barrel;

a pump rod connected to a pump rod reciprocating means;

said pump barrel including an upper barrel and a lower barrel;

said upper barrel comprising a cylindrical member having an axis;

said upper barrel including an upper barrel wall and a central, axial upper barrel aperture;

a plurality of passageways provided in the upper barrel wall;

said passageways in the upper barrel wall aligned with said barrel aperture;

said lower barrel comprising a hollow cylindrical member having an axis and defining an axial lower barrel aperture;

said passageways in fluid communication with said lower barrel aperture;

said passageways and said lower barrel aperture providing fluid communication from said first pump housing interior to said second pump housing interior;

said pump rod slidably contained within said axial upper barrel aperture and said axial lower barrel aperture;

a valve ball connected to said pump rod;

a valve seat sealingly engageable with said valve ball;

said valve seat in a fixed position in relation to said pump barrel;

said valve seat interior of said pump barrel;

said valve ball disposed below said valve seat;

upward reciprocation of said pump rod biasing said valve ball against said valve seat and further biasing said valve seat and said pump barrel upward;

said pump rod including a radially outwardly extending member disposed above said upper barrel;

said outwardly extending member engaging said upper barrel during downward reciprocation of said pump rod;

said outwardly extending member biasing said pump barrel downwardly on downward reciprocation of said pump rod;

said valve ball and said valve seat in sealing engagement during upward reciprocation of said pump rod;

said ball valve and said valve seat disengaged from sealing engagement during downward reciprocation of said pump rod;

said wall apertures allowing fluid communication through said upper barrel between said first pump housing interior and said second pump housing interior during downward reciprocation of said pump rod; and a standing valve disposed below said valve ball and said valve seat, said standing valve in sealing engagement during downward reciprocation of said pump rod and disengaged from sealing engagement during upward reciprocation of said pump rod.

2. A pump according to claim 1 wherein:

said upper barrel threadedly engaged with said lower barrel; and said valve ball extending interior of said lower barrel.

3. A pump according to claim 1 wherein:

said upper barrel further including a hollow, cylindrical collar abutting said valve seat, an interior of said collar providing fluid communication between said valve seat and said wall apertures.

4. A pump according to claim 1 wherein:

said valve seat fixedly retained in said pump barrel between a lower end of said collar and a shoulder positioned interior of said lower barrel.

5. A pump operable in a tubular well string, said well string containing environmental fluid therein, the pump comprising:

a pump housing;

a pump barrel slidably disposed in said pump housing;

a first pump housing interior above said pump barrel;

a second pump housing interior below said pump barrel;

a pump rod connected to a pump rod reciprocating means;

said pump barrel comprising an upper barrel threadably engaged with a lower barrel;

said upper barrel comprising a cylindrical member having an axis;

said upper barrel including an upper barrel wall and a central, axial upper barrel aperture;

a plurality of passageways provided in the upper barrel wall;

said passageways in the upper barrel wall aligned with said barrel aperture;

said lower barrel comprising a hollow cylindrical member having an axis and defining an axial lower barrel aperture;

said passageways in fluid communication with said lower barrel aperture;

said passageways and said lower barrel aperture providing fluid communication from said first pump housing interior to said second pump housing interior;

said pump rod slidably contained within said axial upper barrel aperture and said axial lower barrel aperture;

a valve ball connected to said pump rod;

said valve ball extending interior of said lower barrel;

a valve seat sealingly engageable with said valve ball;

said valve seat in a fixed position in relation to said pump barrel;

said valve seat interior of said pump barrel;

said valve ball disposed below said valve seat;

upward reciprocation of said pump rod biasing said valve ball against said valve seat and further biasing said valve seat and said pump barrel upward;

said pump rod including a radially outwardly extending member disposed above said upper barrel;

said outwardly extending member engaging said upper barrel during downward reciprocation of said pump rod;

said outwardly extending member biasing said pump barrel downwardly on downward reciprocation of said pump rod;

said valve ball and said valve seat in sealing engagement during upward reciprocation of said pump rod;

said ball valve and said valve seat disengaged from sealing engagement during downward reciprocation of said pump rod;

said wall apertures allowing fluid communication through said upper barrel between said first pump housing interior and said second pump housing interior during downward reciprocation of said pump rod; and a standing valve disposed below said valve ball and said valve seat, said standing valve in sealing engagement during downward reciprocation of said pump rod and disengaged from sealing engagement during upward reciprocation of said pump rod.

6. A pump according to claim 5 wherein:

said upper barrel further including a hollow, cylindrical collar abutting said valve seat, an interior of said collar providing fluid communication between said valve seat and said wall apertures.

7. A pump according to claim 6 wherein:

said valve seat fixedly retained in said barrel between a lower end of said collar and a shoulder provided in said lower barrel.

8. A pump operable in a tubular well string, said well string containing environmental fluid therein, the pump comprising:

a pump housing;

a pump barrel slidably disposed in said pump housing;

a first pump housing interior above said pump barrel;

a second pump housing interior below said pump barrel;

a pump rod connected to a pump rod reciprocating means;

said pump barrel comprising an upper barrel threadably engaged with a lower barrel;

said upper barrel comprising a cylindrical member having an axis;

said upper barrel including an upper barrel wall and a central, axial upper barrel aperture;

a plurality of passageways provided in the upper barrel wall;

said passageways in the upper barrel wall aligned with said barrel aperture;

said upper barrel further including a hollow, cylindrical collar abutting a valve seat, an interior of said collar providing fluid communication between said valve seat and said wall apertures;

said lower barrel comprising a hollow cylindrical member having an axis and defining an axial lower barrel aperture;

said passageways in fluid communication with said lower barrel aperture;

said passageways and said lower barrel aperture providing fluid communication from said first pump housing interior to said second pump housing interior;

said pump rod slidably contained within said axial upper barrel aperture and said axial lower barrel aperture;

a valve ball connected to said pump rod;

said valve ball extending interior of said lower barrel;

said valve seat sealingly engageable with said valve ball;

said valve seat in a fixed position in relation to said pump barrel;

said valve seat fixedly retained in said barrel between a lower end of said collar and a shoulder provided in said lower barrel;

said valve ball disposed below said valve seat;

upward reciprocation of said pump rod biasing said valve ball against said valve seat and further biasing said valve seat and said pump barrel upward;

said pump rod including a radially outwardly extending member disposed above said upper barrel;

said outwardly extending member engaging said upper barrel during downward reciprocation of said pump rod;

said outwardly extending member biasing said pump barrel downwardly on downward reciprocation of said pump rod;

said valve ball and said valve seat in sealing engagement during upward reciprocation of said pump rod;

said ball valve and said valve seat disengaged from sealing engagement during downward reciprocation of said pump rod;

said wall apertures allowing fluid communication through said upper barrel between said first pump housing interior and said second pump housing interior during downward reciprocation of said pump rod; and a standing valve disposed below said valve ball and said valve seat, said standing valve in sealing engagement during downward reciprocation of said pump rod and disengaged from sealing engagement during upward reciprocation of said pump rod.

* * * * *